US011671748B2

(12) United States Patent
Matsuo

(10) Patent No.: US 11,671,748 B2
(45) Date of Patent: Jun. 6, 2023

(54) ONBOARD DEVICE

(71) Applicant: TRANSTRON INC., Kanagawa (JP)

(72) Inventor: Hideyuki Matsuo, Kanagawa (JP)

(73) Assignee: TRANSTRON INC., Kanagawa (JP)

( * ) Notice: Subject to any disclaimer, the term of this patent is extended or adjusted under 35 U.S.C. 154(b) by 205 days.

(21) Appl. No.: 17/355,939

(22) Filed: Jun. 23, 2021

(65) Prior Publication Data

US 2021/0321190 A1 Oct. 14, 2021

Related U.S. Application Data

(63) Continuation of application No. PCT/JP2020/011679, filed on Mar. 17, 2020.

(30) Foreign Application Priority Data

Mar. 20, 2019 (JP) ..... JP2019-053189

(51) Int. Cl.
*H04R 1/34* (2006.01)
*H04R 1/02* (2006.01)
(Continued)

(52) U.S. Cl.
CPC ..... *H04R 1/342* (2013.01); *H04R 1/025* (2013.01); *H04R 1/04* (2013.01); *H04R 1/08* (2013.01); *H04R 2499/13* (2013.01)

(58) Field of Classification Search
CPC ..... H04R 1/342; H04R 1/025; H04R 1/04; H04R 1/08; H04R 2499/13
(Continued)

(56) References Cited

U.S. PATENT DOCUMENTS 6,005,957 A * 12/1999 Meeks ..... H04R 1/025 381/71.7
2007/0207840 A1 9/2007 Kurauchi et al.
(Continued)

FOREIGN PATENT DOCUMENTS

EP 3634007 A1 4/2020
JP S60-153089 U 10/1985
(Continued)

OTHER PUBLICATIONS

International Search Report issued in PCT/JP2020/011679 dated Jun. 9, 2020 with English Translation (5 pages).
(Continued)

*Primary Examiner* — Sean H Nguyen
(74) *Attorney, Agent, or Firm* — Nakanishi IP Associates, LLC

(57) ABSTRACT

A small-sized onboard device that includes a speaker and a microphone and is configured to reduce noise caused by an echo is provided. The speaker is provided inside a housing that forms a cavity inside so that a sound emission surface of the speaker faces a direction substantially orthogonal to a front surface, and a first opening is formed in a front surface of the housing. A microphone case and a sound guide member are juxtaposed on the front surface of the housing. A microphone is housed inside the microphone case. The microphone case has a sound pickup hole in a front surface of the microphone case. The sound guide member has a sound guide hole that passes through the sound guide member. The first opening is provided in a vicinity of a top surface or a bottom surface of the housing.

7 Claims, 7 Drawing Sheets

(51) Int. Cl.
*H04R 1/04* (2006.01)
*H04R 1/08* (2006.01)

(58) Field of Classification Search
USPC ..... 381/86
See application file for complete search history.

(56) References Cited

U.S. PATENT DOCUMENTS

| | | | | |
|---|---|---|---|---|
| 2009/0097674 | A1* | 4/2009 | Watson | B60R 11/0247 381/86 |
| 2009/0180648 | A1* | 7/2009 | Endo | H04R 9/046 381/412 |
| 2011/0064238 | A1* | 3/2011 | Haas | H04R 1/2807 381/71.6 |
| 2012/0008794 | A1* | 1/2012 | Gratke | H04R 1/406 381/86 |

FOREIGN PATENT DOCUMENTS

| | | | |
|---|---|---|---|
| JP | H4-220898 | A | 8/1992 |
| JP | 2007-216856 | A | 8/2007 |
| WO | 2018/216694 | A1 | 11/2018 |

OTHER PUBLICATIONS

Extended European Search Report issued in European Patent Application No. 20773143.1, dated Apr. 12, 2022 (7 pages).

* cited by examiner

ONBOARD DEVICE

CROSS-REFERENCE TO RELATED APPLICATIONS

This application is a continuation application of International Patent Application No. PCT/JP2020/011679 filed on Mar. 17, 2020, which claims priority to Japanese Patent Application No. 2019-053189 filed on Mar. 20, 2019, the entire contents of which are incorporated by reference.

TECHNICAL FIELD

The present invention relates to an onboard device.

BACKGROUND ART

Patent Document 1 discloses an audio with built-in speaker and a video apparatus that include a housing and a loudspeaker embedded into the housing. A moulding is disposed above a converter in an acoustic channel and on a top surface of the housing.

CITATION LIST

Patent Literature

Patent Document 1: JP 4-220898 A

In a case where an onboard device is mounted to an automobile to allow making a phone call between a user and an outside world, a device including a speaker and a microphone is required. Since the speaker and the microphone are installed in a small space in a few steps, a device with an integrated speaker and microphone has been required. Meanwhile, in a case where a microphone is equipped with the device described in Patent Document 1 to configure an onboard device, a distance between the speaker and the microphone becomes close, thus generating an echo.

SUMMARY OF INVENTION

One or more embodiments of the present invention provide a small-sized onboard device that includes a speaker and a microphone and is configured to reduce noise caused by an echo.

An onboard device in one or more embodiments of the present invention, for example, includes a speaker, a microphone, a housing, a microphone case, and a sound guide member. The housing forms a cavity inside. The housing internally includes the speaker such that a sound emission surface of the speaker faces a direction (substantially) orthogonal to a front surface. The housing has a first opening formed in the front surface. The microphone case is provided on the front surface of the housing. The microphone is housed inside the microphone case. The microphone case has a sound pickup hole in a front surface of the microphone case. The sound guide member is juxtaposed with the microphone case on the front surface of the housing. The sound guide member has a sound guide hole that passes through the sound guide member. The first opening is provided in a vicinity of a top surface or a bottom surface of the housing. The first opening has a height smaller than a height of the housing. As viewed from the front surface, a position and a size of a second opening on the first opening side of the sound guide hole (substantially) matches a position and a size of the first opening. A third opening on a front side of the sound guide hole is provided to be biased to a side far from the microphone case. The third opening has a height higher than a height of the first opening. At least a part of an inner wall of the sound guide hole is configured by combining a plurality of inclined surfaces having different directions.

According to the onboard device in one or more embodiments of the present invention, the third opening on the front surface side of the sound guide hole is provided to be biased to the side far from the microphone case. Therefore, an echo signal due to a sound wave from the speaker is less likely to be saturated, and an echo can be canceled by electrical processing. At least a part of the inner wall is configured by combining the plurality of inclined surfaces having the different directions. Accordingly, an orientation of a sound from the speaker can be changed smoothly. This allows reducing noise due to Helmholtz resonance.

Here, the at least a part of the inclined surface may be configured by smoothly coupling a first inclined surface and a second inclined surface having different inclination angles with respect to the third opening. This allows reducing a volume of the sound guide hole and suppressing noise due to the Helmholtz resonance.

Here, the housing may include a first flange and a second flange on both left and right ends. The microphone case may include a third flange. The first flange may include a recess corresponding to an outer edge shape of the third flange. The third flange may be fitted to the recess. The housing and the microphone case may be provided in a cabin via a first fastening member inserted into a first through-hole and a third through-hole formed in the first flange and the third flange, respectively, and a second fastening member inserted into a second through-hole formed in the second flange. Accordingly, a vibration due to the sound generated from the speaker is less likely to transmit to the first microphone case, and noise included in a voice signal from the microphone can be reduced.

Here, a plate-like (plate-shaped) member may be provided on an inner wall of the housing so as to face a sound emission surface of the speaker. The housing may internally include a tray having a (substantially) cylindrical shape. The speaker and the plate-like member may be provided inside the tray. As a result, the first opening is configured as an exit of sound from the speaker in a pseudo manner. Additionally, a frequency amplified by the Helmholtz resonance can be outside of a frequency domain where performance should be ensured, for example, a frequency greater than 4000 Hz.

According to one or more embodiments of the present invention, the small-sized onboard device that includes the speaker and the microphone and is configured to reduce noise caused by an echo can be provided.

BRIEF DESCRIPTION OF DRAWINGS

FIGS. 2(A), 2(B), 2(C), 2(D), 2(E), and 2(F) are a front view, a top view, a bottom view, a left side view, a right side view, and a back view, respectively.

FIG. 3(A) is a perspective view from a front surface side and a top surface side, and FIG. 3(B) is a perspective view from a back surface side and the top surface side.

DESCRIPTION OF EMBODIMENTS

Now, with reference to the drawings, detailed description is made on an onboard device according to embodiments of the present invention. In the embodiments described below, a configuration in which the onboard device according to the present invention is applied to a calling device configured to achieve so-called handsfree calling, such as an emergency call, in an automobile is exemplified. However, the onboard device according to the present invention is not limited to the calling device, and can be applied to, for example, a device configured to perform an input to a car navigation device, which is provided in the automobile, and a voice output from the car navigation device.

Figure 1:
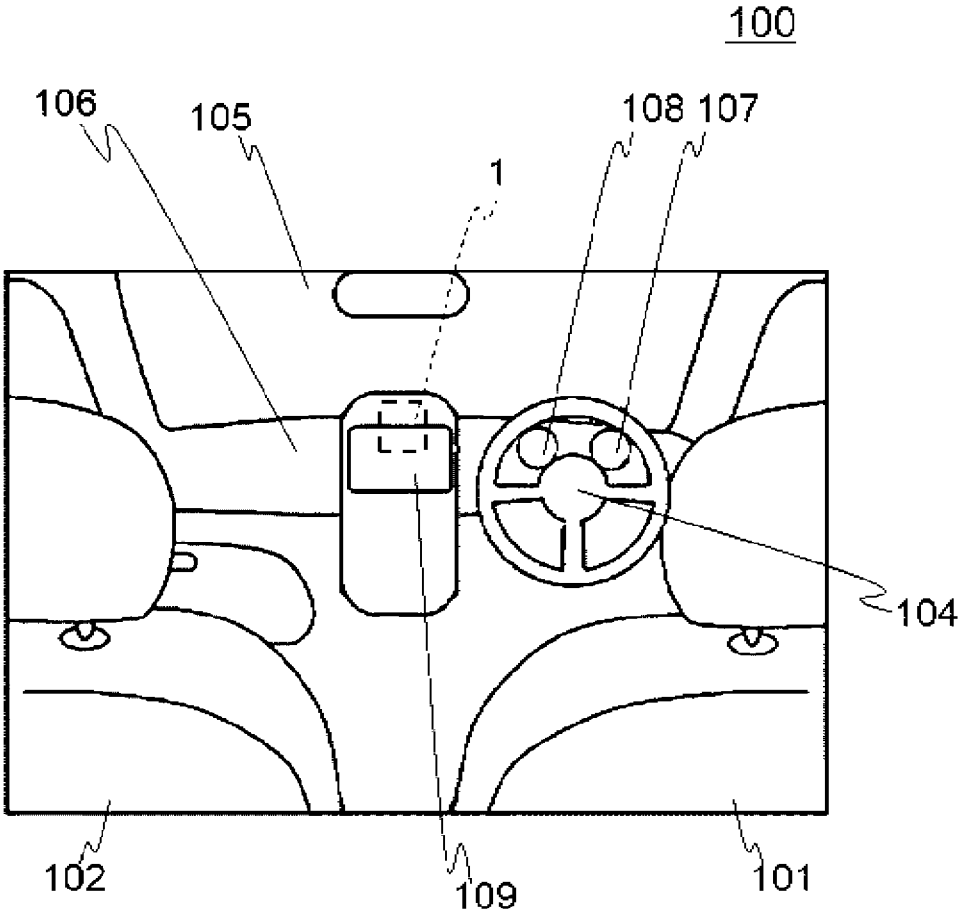
FIG. 1 is a schematic view illustrating a cabin 100 of an automobile to which an onboard device 1 according to a first embodiment is provided.
Figure 2B:
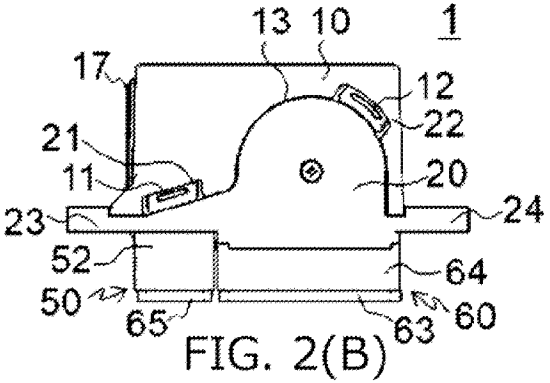
FIGS. 2(A), 2(B), 2(C), 2(D), 2(E), and 2(F) show six side views illustrating an outline configuration of the onboard device 1 according to the first embodiment. More specifically.
Figure 2A:
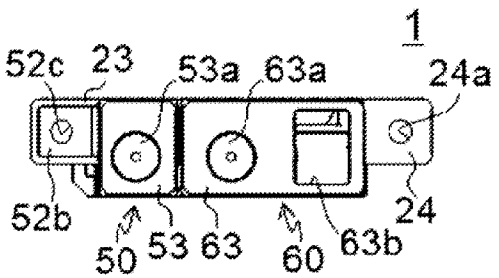
Figure 2C:
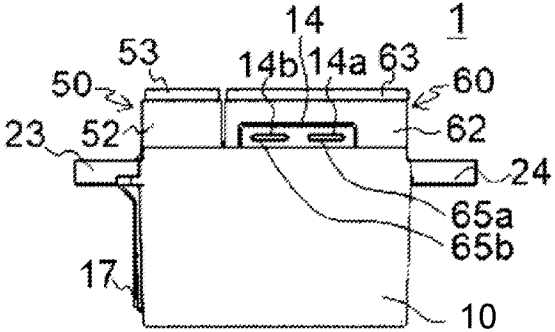
Figure 2D:
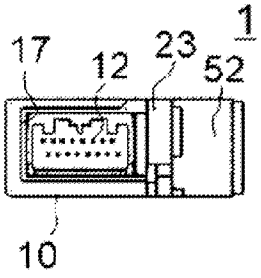
Figure 2E:
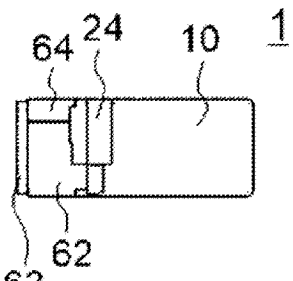
Figure 2F:
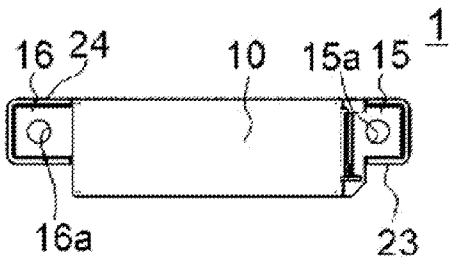

FIG. 1 is a schematic view illustrating a cabin 100 of an automobile to which an onboard device 1 according to a first embodiment is provided. FIG. 1 a schematic view illustrating a part of the cabin 100 when the cabin 100 is viewed from a rear side to a front side. A horizontal direction in FIG. 1 is a vehicle width direction.

In the cabin 100, a driver's seat 101, a passenger's seat 102, and the like are provided. On the front side of the driver's seat 101, a wheel 104 is arranged. On the front side in the cabin 100, a windshield 105, a dashboard 106, and the onboard device 1 are mainly provided.

A speedometer 107, a tachometer 108, and the like are mainly provided to the dashboard 106 in front of the driver's seat 101. A display unit 109 of a car navigation device or the like is mainly provided to the vicinity of the center of the dashboard 106 in the vehicle width direction.

The onboard device 1 is provided on the front side in the cabin and to the vicinity of the center in the vehicle width direction. For example, the onboard device 1 is provided inside an overhead console (not shown) provided to a ceiling center portion above the windshield 105. Note that, the onboard device 1 may be provided inside the dashboard 106, for example, on the back side of the display unit 109.

Figure 3A:
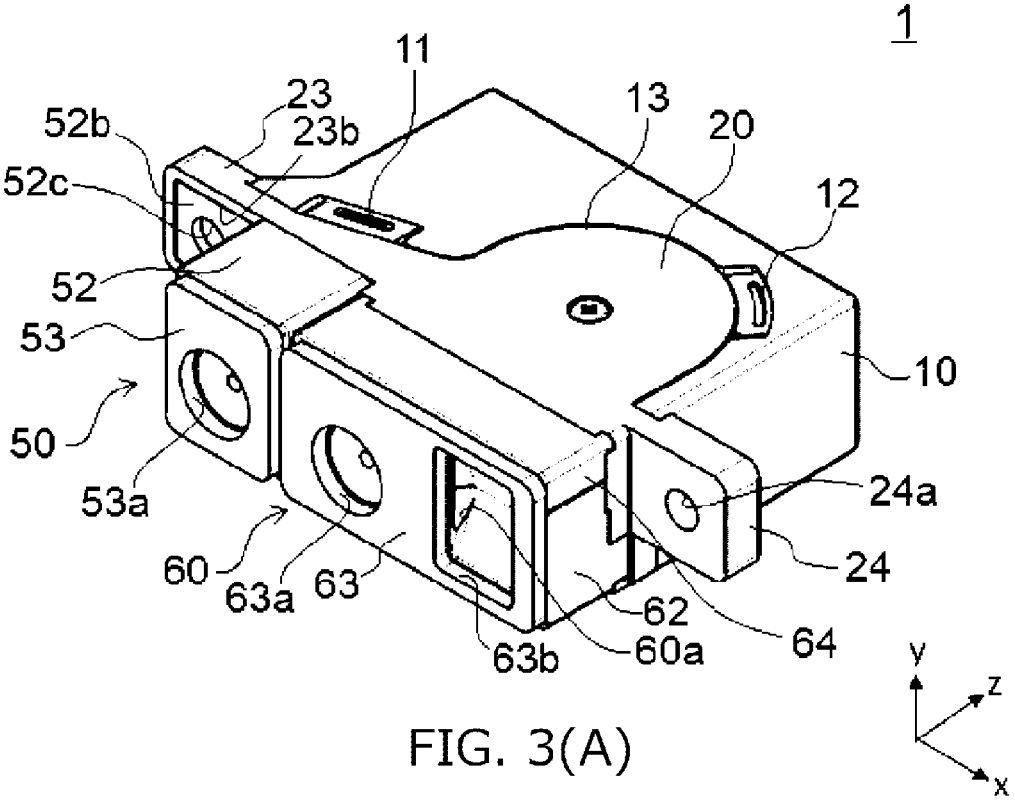
FIGS. 3(A) and 3(B) show perspective views illustrating an outline configuration of the onboard device 1.
Figure 3B:
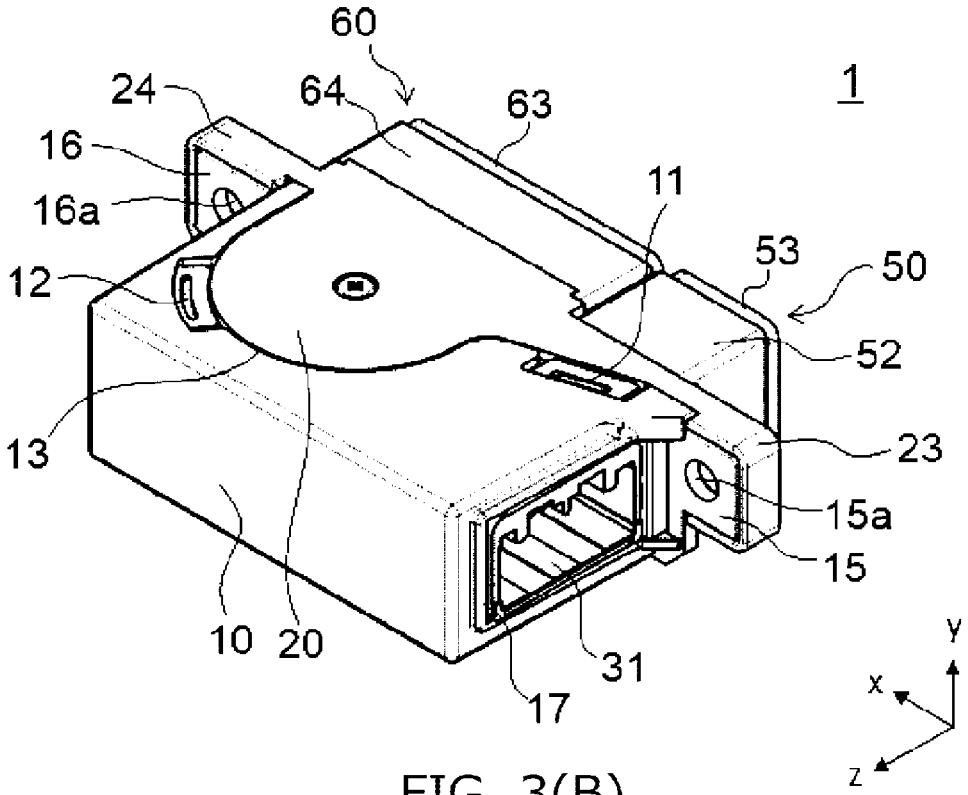

FIG. 2 includes six side views illustrating an outline configuration of the onboard device 1, FIGS. 2(A), 2(B), 2(C), 2(D), 2(E), and 2(F) are a front view, a top view, a bottom view, a left side view, a right side view, and a back view, respectively. FIG. 3 includes perspective views illustrating an outline configuration of the onboard device 1, FIG. 3(A) is a perspective view from a front surface side and a top surface side, and FIG. 3(B) is a perspective view from a back surface side and the top surface side. The front surface of the onboard device 1 is substantially parallel to an x-y plane, a direction from left to right when viewed from the front surface is defined as an +x direction, and a direction from the bottom to the top is defined as a +y direction. Furthermore, a direction from the near side to the far side is defined as a +z direction.

The onboard device 1 is a so-called speaker-microphone-integrated device including a speaker and a microphone. The onboard device 1 mainly includes an upper case 10, a lower case 20, a main substrate 30 (see FIGS. 4 and 5), a sound emission unit 40 (see FIGS. 4 and 5), a first microphone unit 50, and a second microphone unit 60.

The upper case 10 and the lower case 20 are a housing that constitutes a substantial outer shape of the onboard device 1. The upper case 10 and the lower case 20 are joined to form a cavity therein. Elongated fitting holes 11, 12 provided in the top surface of the upper case 10 are fitted to convex portions 21, 22 of the lower case 20, and thus the upper case 10 is coupled to the lower case 20.

The upper case 10 is a box-like member having a substantially rectangular parallelepiped shape. A substantially semicircular-shaped notch portion 13 notched so that the top surface of the lower case 20 is exposed is formed in the upper case 10. In the left side surface of the upper case 10, a through-hole 17 having a substantially rectangular shape from which a connector 31 (described later) of the main substrate 30 is exposed is formed, thus ensuring coupling the outside of the onboard device 1 to the connector 31. A protrusion 14 having a substantially rectangular shape protrudes from the bottom surface of the upper case 10. The protrusion 14 has elongated fitting holes 14*a*, 14*b* arranged in the left-right direction to which convex portions 65*a*, 65*b* (described later) of the second microphone unit 60 are fitted together, respectively.

Upper case flanges 15, 16, which are flat plates having substantially rectangular shapes with flat surfaces on the front surface side, protrude from respective both left and right ends of the upper case 10. The upper case flanges 15, 16 have shapes corresponding to lower case flanges 23, 24 of the lower case 20, respectively. The upper case flange 15 and the lower case flange 23, and the upper case flange 16 and the lower case flange 24 are coupled to each other. The upper case flanges 15, 16 have upper through-holes 15*a*, 16*a*, which pass through from the front surface side to the back surface side, at substantially the centers. The lower case flanges 23, 24 have lower through-holes 23*a* (see FIGS. 4 and 5), 24*a* coaxially with the upper through-holes 15*a*, 16*a*, respectively. A pair of fastening members (for example, screws) are inserted through the respective upper through-hole 15*a* and lower through-hole 23*a* and upper through-hole 16*a* and lower through-hole 24*a*. By screwing the fastening members into screw holes (not illustrated) provided in the automobile, the upper case 10 and the lower case 20 are provided in a cabin via the fastening members.

The lower case 20 is housed inside the upper case 10 with the sound emission unit 40 (described later) held therein. The first microphone unit 50 and the second microphone unit 60 are juxtaposed on the front side (the −z side) of the lower case 20, that is, on the side opposite to the sound emission unit 40.

The respective first microphone unit 50 and second microphone unit 60 are members having substantially rectangular parallelepiped shapes provided on the front surfaces of the upper case 10 and the lower case 20, and are disposed to be arranged in the left-right direction. The first microphone unit 50 and the second microphone unit 60 internally house microphones, which are not illustrated, that convert sounds into electrical signals. The microphones are, for example, micro electronics mechanical system (MEMS) microphones.

The first microphone unit 50 constitutes its outer shape by a first microphone case 52 and a first outer plate 53 coupled corresponding to the shape of the front surface, but the first outer plate 53 may be integrated with the first microphone case 52. The first outer plate 53 has a sound pickup hole 53*a* of the first microphone unit 50 at substantially the center in the front surface.

The first microphone unit 50 includes a flat plate-shaped flange 52*b* protruding to the left side (the +x side) in front view. The flange 52*b* has an end surface having a substantially rectangular shape, which is a shape corresponding to the lower case flange 23. A rectangular recess 23*b* corresponding to an outer edge shape of the flange 52*b* of the first microphone unit 50 is formed on the lower case flange 23 of the lower case 20, and the flange 52*b* is fitted to the recess 23*b*. A hole 52*c* is provided approximately at the center of the flange 52*b* at a position corresponding to the upper through-hole 15*a* and the lower through-hole 23*a*. The fastening member is inserted into the upper through-hole 15*a*, the lower through-hole 23*a*, and the hole 52*c* in this order and is screwed into the screw hole (not illustrated) in the cabin. Thus, the upper case 10, the lower case 20, and the first microphone case 52 are provided in the cabin via the fastening member.

The second microphone unit 60 is juxtaposed with the first microphone case 52, and has a width in the left-right direction (the x direction) larger than that of the first microphone unit 50. The second microphone unit 60 constitutes its outer shape by a second microphone case 62, a second outer plate 63 coupled corresponding to the shape of the front surface, and a second microphone case cover 64, but the second outer plate 63 and the second microphone case cover 64 may be integrated with the second microphone case 62. The second microphone case 62, the second outer plate 63, and the second microphone case cover 64 are equivalent to a sound guide member. The sound guide member has a sound guide hole 60*a* that passes through the sound guide member from the front surface to the back face (in the z direction). The sound guide hole 60*a* transmits sound waves from the sound emission unit 40 to the outside of the onboard device 1. The sound guide hole 60*a* will be described in detail later.

The second outer plate 63 is provided with a sound pickup hole 63*a* and a sound emission hole 63*b*. The sound emission hole 63*b* is included in the sound guide hole 60*a* and is an opening on the front surface side of the sound guide hole 60*a*. The sound emission hole 63*b* has a substantially rectangular shape and is provided biased to the end on the side far from the first microphone case 52 (the first microphone unit 50). Note that the shape of the sound emission hole 63*b* is not limited to the substantially rectangular shape.

Figure 4:
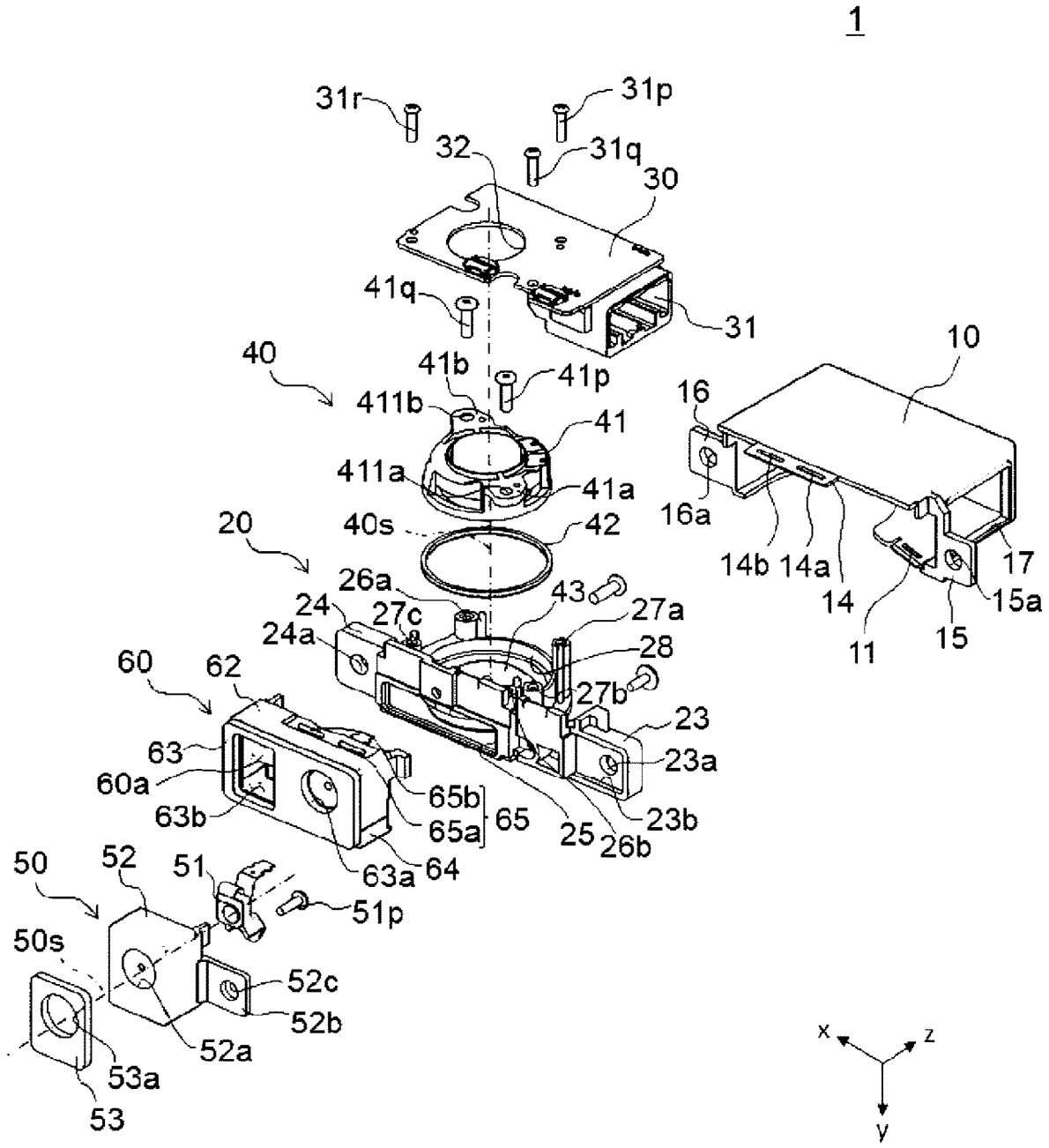
FIG. 4 is an exploded perspective view of the onboard device 1 from the front surface side and a bottom surface side.
Figure 5:
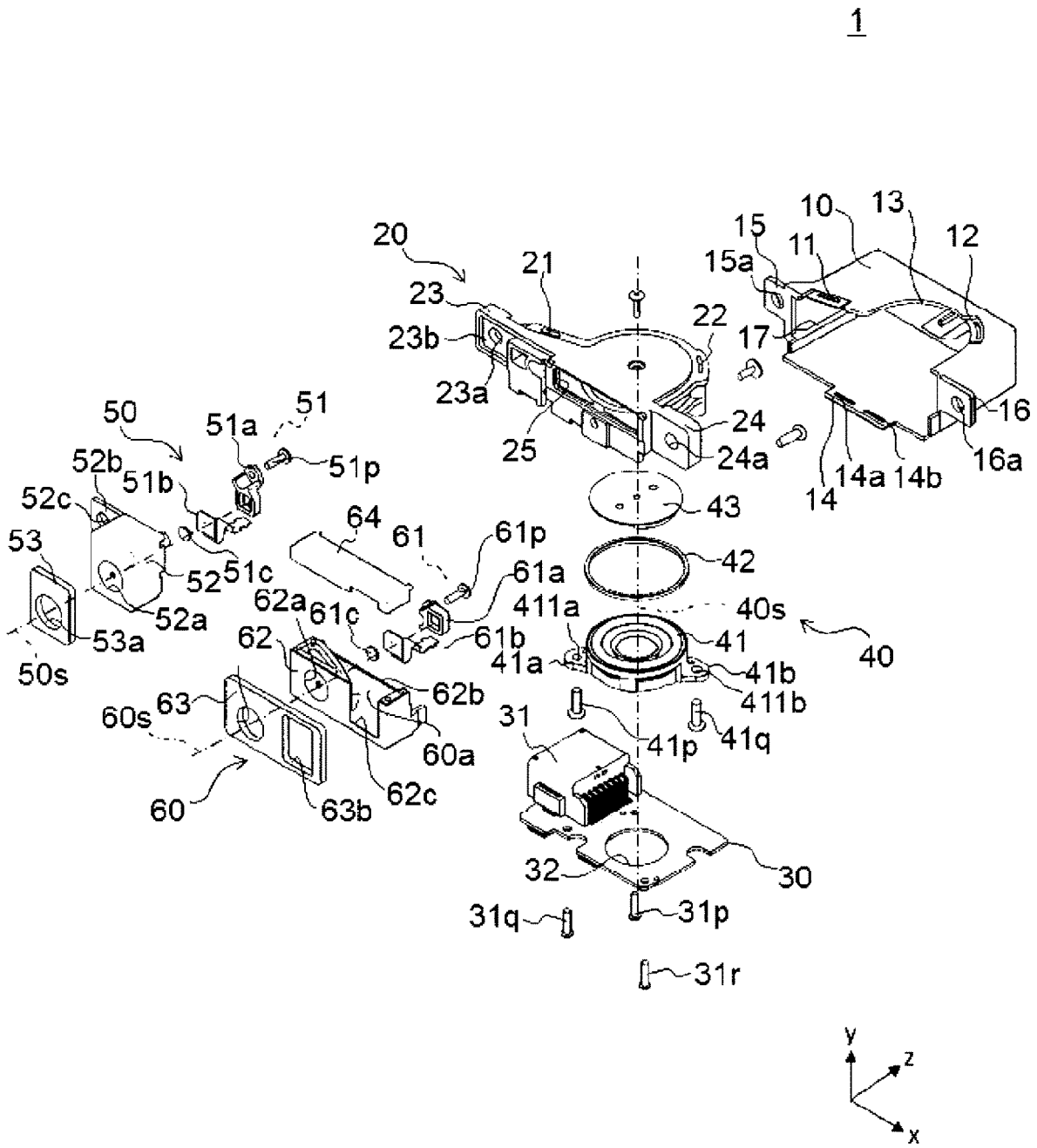
FIG. 5 is an exploded perspective view from the front surface side and the top surface side of the onboard device 1.

FIG. 4 is an exploded perspective view of the onboard device 1 from the front surface side and a bottom surface side. FIG. 5 is an exploded perspective view from the front surface side and the top surface side of the onboard device 1.

The lower case 20 has a generally-cylindrical shaped tray 28 that holds the sound emission unit 40. The tray 28 is formed on the back surface side of the lower case 20. The lower case 20 is housed inside the upper case 10 with the sound emission unit 40 held on the top surface side of the tray 28. In other words, a sound emission surface of a speaker 41 of the sound emission unit 40 is provided inside the upper case 10 and the lower case 20 so as to face a direction substantially orthogonal to the front surface (the y direction). A sound hole 25 (equivalent to a first opening) is formed in the front surface of the lower case 20, and the opening direction of the sound hole 25 is different from the sound emission direction of the sound emission unit 40.

The sound hole 25 is provided in the vicinity of a top surface of a housing (the assembly of the upper case 10 and the lower case 20). A size of the sound hole 25 in the height direction (the y direction) is smaller than a size of the housing in the height direction, and is approximately the half of the size of the housing in the height direction.

The main substrate 30 is electrically connected to the respective sound emission unit 40, first microphone unit 50, and second microphone unit 60. The main substrate 30 is coupled with screw holes 27*a*, 27*b*, 27*c* in the top surface of the lower case 20 and screws 31*p*, 31*q*, and 31*r*. The connector 31 to which a power source is supplied is disposed on the top surface of the main substrate 30. In addition, a through-hole 32 through which the center portion of the sound emission unit 40 passes is formed at the substantially center of the main substrate 30.

The sound emission unit 40 mainly includes the speaker 41, a ring 42, and a plate-like member 43. The speaker 41, the ring 42, and the plate-like member 43 are layered in this order from the bottom surface side to the top surface side.

The speaker 41 is a member that outputs, for example, a voice, and is an approximately disk-shaped member including a vibration plate at the center portion. Since the speaker 41 is provided sideways, a center line 40*s* extending in a thickness direction of the speaker 41 extends in a thickness direction (the y direction) of the upper case 10.

At the center portion of the speaker 41, the top surface is recessed and the bottom surface protrudes. The speaker 41 includes radially protruding ribs 41*a*, 41*b*, and the ribs 41*a*, 41*b* include through-holes 411*a*, 411*b*, respectively. Screws 41*p*, 41*q* inserted through the through-holes 411*a*, 411*b* are screwed into screw holes 26*a*, 26*b* in the lower case 20, and thus the speaker 41 is coupled to the lower case 20.

The ring 42 and the plate-like member 43 are members provided on a substantially concentric circle of the vibration plate of the speaker 41. The plate-like member 43 protrudes so that the top surface side is substantially flat and the bottom surface side is entered into the depressed surface of the speaker 41. A gap is formed between the plate-like member 43 and the speaker 41, and air within the gap vibrates in accordance with the vibration plate. The ring 42 is a circular ring member having a size corresponding to the outer periphery of the plate-like member 43. The plate-like member 43 and the speaker 41 are fitted to both surfaces of the ring 42, thus positioning the plate-like member 43 and the speaker 41.

Since the speaker 41 is oriented sideways, that is, the sound emission surface of the speaker 41 faces in a direction substantially orthogonal to the front surface, in a case where a gap present in the front surface of the sound emission surface of the speaker 41 is large, this causes Helmholtz resonance, resulting in amplification of a specific frequency. In the present embodiment, since the speaker 41 and the plate-like member 43 are provided inside the tray 28 and the plate-like member 43 is provided facing the sound emission surface of the speaker 41, the volume of a space in the front surface of the speaker 41 is reduced and the sound hole 25 is configured as an exit of sound from the speaker 41 in a pseudo manner. This allows the frequency amplified by Helmholtz resonance to be outside of a frequency domain where performance should be ensured, for example, a frequency greater than 4000 Hz.

The first microphone unit 50 mainly includes a first microphone holding unit 51, the first microphone case 52, and the first outer plate 53. The first microphone holding unit 51 includes a microphone holder 51*a*, a microphone flexible joint 51*b*, and a microphone cushion 51*c*. The microphone holder 51*a*, the microphone flexible joint 51*b*, and the microphone cushion 51*c* are stacked in this order to the first microphone case 52, and are mounted to the first microphone case 52 via a screw 51*p* inserted through a through-hole formed in the microphone holder 51*a*.

The microphone holder 51*a* is a member that pushes the microphone (not illustrated) inside the first microphone case 52 to hold the microphone. The microphone flexible joint 51*b* is a member having an elastic force to support the microphone and is configured by bending an elongated flat plate, for example. The microphone cushion 51*c* is an elastic body sandwiched between the microphone and the microphone flexible joint 51*b*.

A sound pickup hole 52*a* in the first microphone case 52 and the sound pickup hole 53*a* in the first outer plate 53 are provided on a center line 50*s* of the microphone and are positioned so as to overlap in front view. Sound that has passed through the sound pickup holes 52*a* and the sound pickup hole 53*a* is guided to the microphone (not illustrated).

The second microphone unit 60 mainly includes a second microphone holding unit 61, the second microphone case 62, the second outer plate 63, and the second microphone case cover 64. The second microphone holding unit 61 includes a microphone holder 61*a*, a microphone flexible joint 61*b*, and a microphone cushion 61*c*. Since the configuration is substantially the same as that of the first microphone holding unit 51, the description thereof will be omitted. A center line 60*s* of the microphone, which is not illustrated, held by the microphone holder 61*a* extends in the z direction.

A sound pickup hole 62*a* in the second microphone case 62 and the sound pickup hole 63*a* in the second outer plate 63 are provided on the center line 60*s* of the microphone and are positioned so as to overlap in front view. Sound that has passed through the sound pickup hole 62*a* and the sound pickup hole 63*a* is guided to the microphone (not illustrated).

The back surface side of the second microphone case 62 is coupled to the front surface side (the −z side) of the lower case 20, and an opening 62*b* is adjacent to the sound hole 25. That is, the sound guide hole 60*a* is provided adjacent to the sound hole 25. The sound guide hole 60*a* communicates between the sound hole 25 in the lower case 20 and the outside of the onboard device 1 to guide sound waves from the sound holes 25 to the outside of the onboard device 1. As seen from the front surface, the position and size of the opening 62*b* on the sound hole 25 side (the back surface side) of the sound guide hole 60*a* substantially matches the position and the size of the sound hole 25. In other words, the opening 62*b* is provided at the center portion and in the vicinity of the top surface of the second microphone case 62.

An opening 62*c*, which is an opening on the front surface side of the sound guide hole 60*a*, is adjacent to the sound emission hole 63*b*. As seen from the front surface, the position and the size of the opening 62*c* substantially matches the position and the size of the sound emission hole 63*b*. The opening 62*c* and the sound emission hole 63*b* are sound emission holes that emit sound waves to the outside of the onboard device 1. The opening 62*c* and the sound emission hole 63*b* are substantially rectangular-shaped holes, and heights of the opening 62*c* and the sound emission hole 63*b* are higher than the height of the sound holes 25 and substantially match the height of the second microphone unit 60. As a result, the opening 62*c* and the sound emission hole 63*b* are large to the maximum, thereby improving a sound emission property.

The opening 62*c* and the sound emission hole 63*b* are provided to be biased to the side (the +x side) far from the first microphone unit 50. Accordingly, the microphone of the first microphone unit 50 is less likely to be susceptible to the sound waves from the speaker 41. For example, when the distance between the sound emission hole from the speaker 41 and the microphone of the first microphone unit 50 is close, an echo on the sound of the microphone is saturated in a case where the voice from the speaker 41 is large, failing to cancel the echo by electrical processing. In contrast, in the present embodiment, the opening 62*c* and the sound emission hole 63*b* are provided in the vicinity of the end (the +x end) on the side far from the first microphone unit 50, thus ensuring reducing echo components caused by the voice from the speaker 41 and picking up a speech of a speaker more clearly.

Figure 6A:
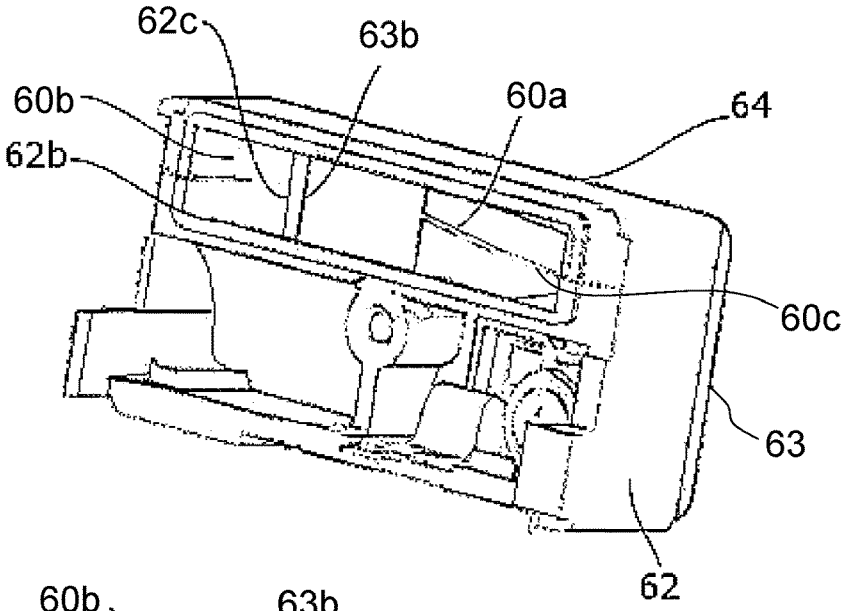
FIGS. 6(A) and 6(B) are perspective views of a second microphone case 62, a second outer plate 63, and a second microphone case cover 64 from the back surface side.
Figure 6B:
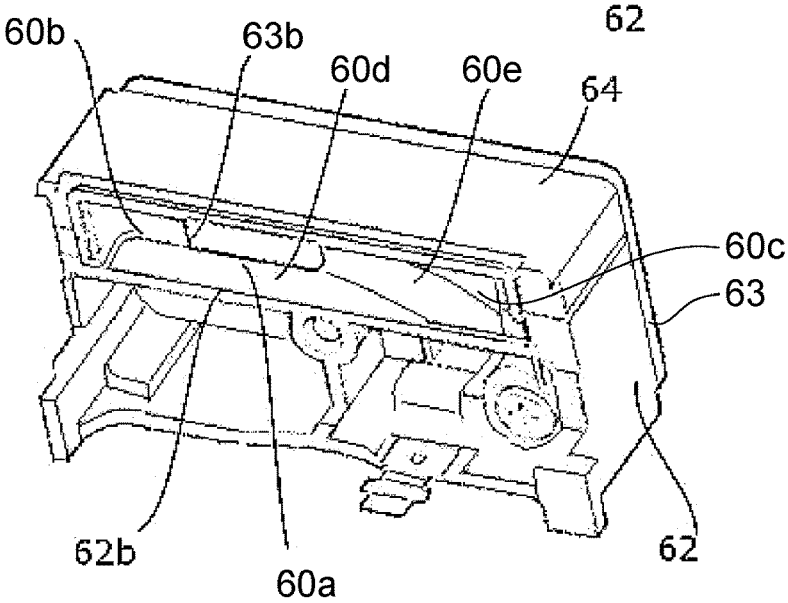
Figure 6C:
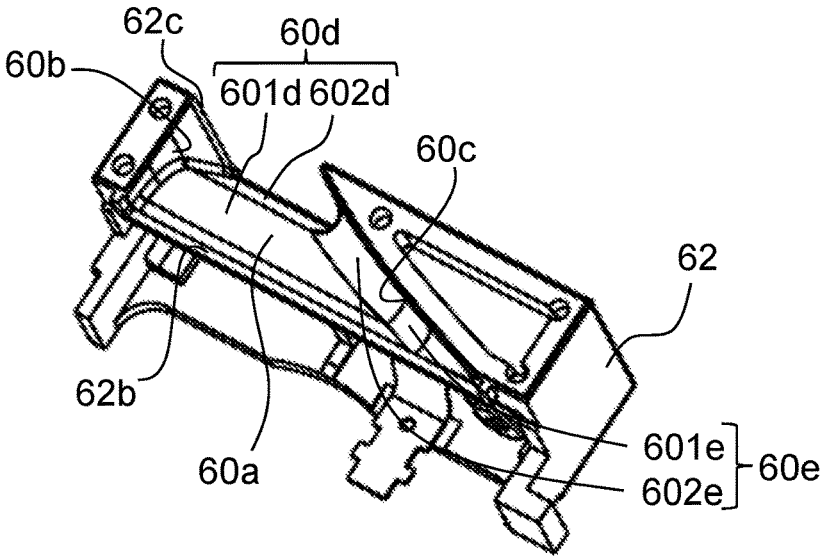
FIG. 6(C) is a perspective view of the second microphone case 62 from the top surface side.

FIGS. 6(A) and 6(B) are perspective views of the second microphone case 62, the second outer plate 63, and the second microphone case cover 64 from the back surface side, and FIG. 6(C) is a perspective view of the second microphone case 62 from the top surface side.

The second microphone case 62 is a member having a substantially rectangular parallelepiped shape with open top surface and back surface inside of which is a hollow. The top surface side of the second microphone case 62 is covered with the second microphone case cover 64. Note that the second microphone case cover 64 may be integrated with the second microphone case 62.

The hollow formed by the second microphone case 62 and the second microphone case cover 64 is the sound guide hole 60*a*. Both ends of the sound guide hole 60*a* are the respective opening 62*b*, opening 62*c*, and sound emission hole 63*b*.

The sound guide hole 60*a* is configured to be surrounded by a first inner wall 60*b*, a second inner wall 60*c*, and a third inner wall 60*d*, which are inner walls of the second microphone case 62, and an inner wall of the second microphone case cover 64. The second inner wall 60*c* and the third inner wall 60*d* have different inclination directions. In other words, at least a part of the inner wall of the sound guide hole 60*a* is configured by combining the plurality of inclined surfaces having the different directions.

The first inner wall 60*b* is an inner wall constituting the right side surface of the sound guide hole 60*a*, and is a plane substantially parallel to an opposed external wall of the second microphone case 62.

The second inner wall 60*c* is an inclined surface constituting the left side surface of the sound guide hole 60*a*, and is obliquely inclined smoothly from the left end (the end on the −x side) of the opening 62*b* toward the left end of the opening 62*c*.

The third inner wall 60*d* is an inclined surface constituting the bottom surface side of the sound guide hole 60*a*, and smoothly connects lower ends of the opening 62*b* and the opening 62*c*. The third inner wall 60*d* is configured by smoothly joining two first inclined surface 601*d* and second inclined surface 602*d* having different inclination angles with respect to an end surface (an opening surface) of the opening 62*c*. The first inclined surface 601*d* and the second inclined surface 602*d* may have curvatures or may be straight inclined surfaces not having curvatures. Furthermore, an angle formed by the opening surface (the x-y plane) of the opening 62*c* and the first inclined surface 601*d* is smaller than an angle formed by the opening surface of the opening 62*c* and the second inclined surface 602*d*.

Left and right ends of the third inner wall 60*d* are coupled to the first inner wall 60*b* and the second inner wall 60*c*, respectively. The coupling portions of the second inner wall 60*c* and the third inner wall 60*d* are coupled with a smooth curved surface 60*e*. The curved surface 60*e* has a slope shape extending so as to lower in the +x, −y, and −z directions from the opening 62*b* toward the opening 62*c*. The curved surface 60*e* is an inclined surface, and is a twisted slope particularly at the lower portion.

The curved surface 60*e* is configured by smoothly joining two first curved surface 601*e* and second curved surface 602*e* having different inclination angles with respect to the opening surface of the opening 62*c*. An angle formed by the opening surface of the opening 62*c* and the first curved surface 601*e* is smaller than an angle formed by the opening surface of the opening 62*c* and the second curved surface 602*e*.

The configuration of the sound guide hole 60*a* as described above reduces the volume of the sound guide hole 60*a* while smoothly changing the orientation of sound from the speaker 41, thus suppressing Helmholtz resonance.

According to the present embodiment, the speaker 41 and the plurality of microphones are provided inside the upper case 10 and the lower case 20 to provide the speaker 41 and the plurality of microphones on one surface (here, the front surface). Thus, it is only required that the upper case 10 and the lower case 20 be installed inside the cabin 100 such that the front surfaces face the inside of the cabin 100. Therefore, the onboard device 1 can be downsized and easily arranged inside the cabin 100. Then, the opening 62*c* and the sound emission hole 63*b* are provided to be biased on the side far from the first microphone unit 50, and the sound guide hole 60*a* in which a part of the surface is constituted by combining the plurality of inclined surfaces having the different directions guides the sound from the speaker 41 to the opening 62*c* and the sound emission hole 63*b*. Thus, the echo components caused by the voice from the speaker 41 can be reduced.

In addition, according to the present embodiment, a first inclined surface 621*f* and a second inclined surface 622*f* are smoothly coupled, an angle formed by the opening surface of the opening 62*c* and the first inclined surface 621*f* is configured to be smaller than an angle formed by the end surface of the opening 62*c* and the second inclined surface 622*f*, the first curved surface 601*e* and the second curved surface 602*e* are smoothly coupled, and an angle formed by the end surface of the opening 62*c* and the first curved surface 601*e* is configured to be smaller than an angle formed by the end surface of the opening 62*c* and the second curved surface 602*e*. This allows reducing the volume of the sound guide hole 60*a* while smoothly changing the orientation of sound from the speaker 41, thus ensuring suppressing Helmholtz resonance.

Figure 7:
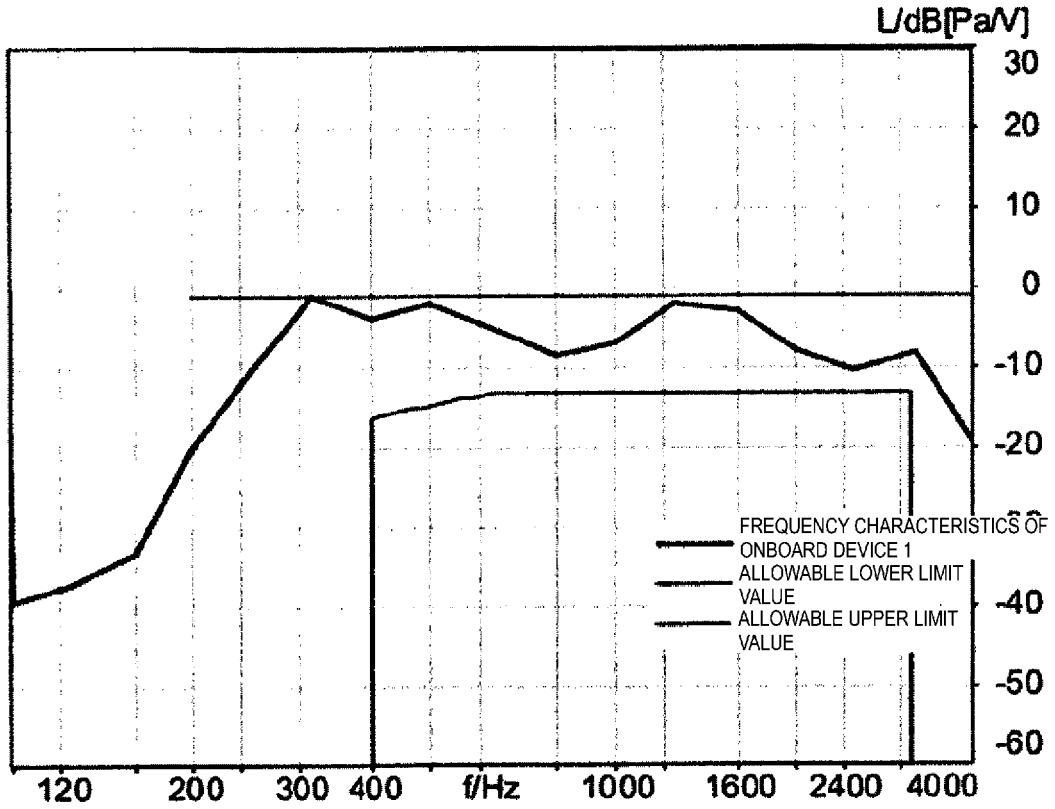
FIG. 7 is a diagram illustrating an example of frequency characteristics of the onboard device 1.

FIG. 7 is a diagram illustrating an example of frequency characteristics of the onboard device 1. As illustrated in FIG. 7, an allowable upper limit value and an allowable lower limit value are defined in 400 Hz to 4000 Hz by the communication standard. Since the onboard device 1 can suppress the Helmholtz resonance, the frequency characteristics of the onboard device 1 fall between the allowable upper limit value and the allowable lower limit value in the frequency band.

In addition, according to the present embodiment, the lower case 20 and the first microphone unit 50 are the separate components, the lower case 20 and the first microphone unit 50 include the lower case flange 23 and the flange 52*b*, respectively, and the lower case flange 23 and the flange 52*b* are fastened together to a vehicle body with the fastening members. Accordingly, vibrations generated near the center of the onboard device 1 by the speaker 41 can be less likely to transmit to the first microphone unit 50, and noise included in a voice signal from the microphone of the first microphone unit 50 can be reduced.

Note that, in the present embodiment, the second microphone unit 60 includes the microphone, but the microphone is not essential. That is, the second microphone unit 60 only need to include the second microphone case 62, the second outer plate 63, and the second microphone case cover 64.

In the present embodiment, the sound emission surface of the speaker 41 is provided so as to face upward (the +y direction) and the sound hole 25 is provided in the vicinity of the top surface of the housing (the assembly of the upper case 10 and the lower case 20), but the sound emission surface of the speaker 41 may be provided so as to face downward (the −y direction) and the sound hole 25 may be provided in the vicinity of the bottom surface of the housing. In this case, the sound guide hole 60*a* only needs to be configured to be vertically opposite.

The embodiments of the invention are described above in detail with reference to the drawings. However, specific configurations are not limited to the embodiments and also include changes in design or the like without departing from the gist of the invention.

Additionally, in the present disclosure, "substantially" is a concept not only including the case of being strictly the same, but also including an error and deformation to the extent that a loss of identity does not occur. For example, a term "substantially parallel" and a term "substantially orthogonal" are not limited to "strictly parallel" and "strictly orthogonal." In addition, for example, terms such as "parallel," "orthogonal," and the like include "substantially parallel," "substantially orthogonal," and the like, respectively. To put it differently, those terms are not strictly limited to the parallel state, orthogonal state, or the like, respectively. In addition, the term "vicinity" is used in the present disclosure to mean a concept where, for example, a place in the vicinity of a certain point A may include the point A or otherwise as long as the place is near the point A.

Reference Signs List

1: Onboard device
10: Upper case
11, 12: Fitting hole
13: Notch portion
14: Protrusion
14a, 14b: Fitting hole
15, 16: Upper case flange
15a, 16a: Upper through-hole
17: Through-hole
20: Lower case
21, 22: Convex portion
23, 24: Lower case flange
23a, 24a: Lower through-hole
23b: Recess
25: Sound hole
26a, 26b, 27a, 27b, 27c: Screw hole
28: Tray
30: Main substrate
31: Connector
31p, 31q, 31r: Screw
32: Through-hole
40: Sound emission unit
40s: Center line
41: Speaker
41a, 41b: Rib
41p, 41q: Screw
42: Ring
43: Plate-like (Plate-shaped) member
50: First microphone unit -continued

| Reference Signs List |
|---|
| 50s: Center line |
| 51: First microphone holding unit |
| 51a: Microphone holder |
| 51b: Microphone flexible joint |
| 51c: Microphone cushion |
| 51p: Screw |
| 52 First microphone case |
| 52a: Sound pickup hole |
| 52b: Flange |
| 52c: Hole |
| 53: First outer plate |
| 53a: Sound pickup hole |
| 60: Second microphone unit |
| 60a: Sound guide hole |
| 60b: First inner wall |
| 60c: Second inner wall |
| 60d: Third inner wall |
| 60e: Curved surface |
| 60s: Center line |
| 61: Second microphone holding unit |
| 61a: Microphone holder |
| 61b: Microphone flexible joint |
| 61c: Microphone cushion |
| 62: Second microphone case |
| 62a: Sound pickup hole |
| 62b, 62c: Opening |
| 63: Second outer plate |
| 63a: Sound pickup hole |
| 63b: Second emission hole |
| 64: Second microphone case cover |
| 65a, 65b: Convex portion |
| 100: Cabin |
| 101: Driver's seat |
| 102: Passenger's seat |
| 104: Wheel |
| 105: Windshield |
| 106: Dashboard |
| 107: Speedometer |
| 108: Tachometer |
| 109: Display unit |
| 411a, 411b: Through-hole |
| 601d: First inclined surface |
| 601e: First curved surface |
| 602d: Second inclined surface |
| 602e: Second curved surface |
| 621f: First inclined surface |
| 622f: Second inclined surface |

The invention claimed is:

1. An onboard device comprising:

a speaker;

a microphone;

a housing that forms a cavity inside, the housing internally including the speaker such that a sound emission surface of the speaker faces a direction orthogonal to a front surface, the housing having a first opening formed in the front surface;

a microphone case provided on the front surface of the housing, the microphone being housed inside the microphone case, the microphone case having a sound pickup hole in a front surface of the microphone case; and a sound guide member juxtaposed with the microphone case on the front surface of the housing, the sound guide member having a sound guide hole that passes through the sound guide member, wherein the first opening is provided in a vicinity of a top surface or a bottom surface of the housing;

the first opening has a height smaller than a height of the housing, as viewed from the front surface, a position and a size of a second opening on the first opening side of the sound guide hole matches a position and a size of the first opening, a third opening on a front side of the sound guide hole is provided to be biased to a side far from the microphone case, the third opening has a height higher than a height of the first opening, and at least a part of an inner wall of the sound guide hole is configured by combining a plurality of inclined surfaces having different directions.

2. The onboard device according to claim 1, wherein the at least a part of the inclined surface is configured by smoothly coupling a first inclined surface and a second inclined surface having different inclination angles with respect to the third opening.

3. The onboard device according to claim 2, wherein the housing includes a first flange and a second flange on both left and right ends, the microphone case includes a third flange, the first flange includes a recess corresponding to an outer edge shape of the third flange, the third flange is fitted to the recess, and the housing and the microphone case are provided in a cabin via a first fastening member inserted into a first through-hole and a third through-hole formed in the first flange and the third flange, respectively, and a second fastening member inserted into a second through-hole formed in the second flange.

4. The onboard device according to claim 2, comprising a plate-shaped member provided on an inner wall of the housing so as to face a sound emission surface of the speaker, wherein the housing internally includes a tray having a cylindrical shape, and the speaker and the plate-shaped member are provided inside the tray.

5. The onboard device according to claim 1, wherein the housing includes a first flange and a second flange on both left and right ends, the microphone case includes a third flange, the first flange includes a recess corresponding to an outer edge shape of the third flange, the third flange is fitted to the recess, and the housing and the microphone case are provided in a cabin via a first fastening member inserted into a first through-hole and a third through-hole formed in the first flange and the third flange, respectively, and a second fastening member inserted into a second through-hole formed in the second flange.

6. The onboard device according to claim 5, comprising a plate-shaped member provided on an inner wall of the housing so as to face a sound emission surface of the speaker, wherein the housing internally includes a tray having a cylindrical shape, and the speaker and the plate-shaped member are provided inside the tray.

7. The onboard device according to claim 1, comprising a plate-shaped member provided on an inner wall of the housing so as to face a sound emission surface of the speaker, wherein the housing internally includes a tray having a cylindrical shape, and the speaker and the plate-shaped member are provided inside the tray.

* * * * *